United States Patent [19]

Ela et al.

[11] Patent Number: 4,600,964

[45] Date of Patent: Jul. 15, 1986

[54] LIFTING MAGNET SYSTEM

[75] Inventors: Roger B. Ela, Spencer; Paul H. Guerin, Clinton, both of Mass.

[73] Assignee: Walker Magnetics Group, Inc., Worcester, Mass.

[21] Appl. No.: 705,014

[22] Filed: Feb. 25, 1985

[51] Int. Cl.[4] ..... H01F 7/20

[52] U.S. Cl. ..... 361/144; 361/154

[58] Field of Search ..... 361/144, 145, 154

[56] References Cited

U.S. PATENT DOCUMENTS 3,036,245 5/1962 Fourey ..... 361/154 X

*Primary Examiner*—Michael L. Gellner

*Attorney, Agent, or Firm*—Henry D. Pahl, Jr.

[57] ABSTRACT

In the lifting magnet system disclosed herein, demagnetization and releasing of a load are accomplished without switching inductively loaded d.c. power by employing a.c. energization, through respective bridge rectifiers, of entirely separate lifting and drop coils.

3 Claims, 2 Drawing Figures

"H" TYPE MAGNET SYSTEM

LIFTING MAGNET SYSTEM

BACKGROUND OF THE INVENTION

The present invention relates to lifting magnets and, more particularly, to a control system for selectively energizing and demagnetizing a lifting magnet.

As is well understood in the art, residual magnetism in the core of a lifting magnet and in a magnetically permeable load held by the magnet may make it impossible to release the load merely by deenergizing the lifting magnet. Accordingly, various systmes have been developed for obtaining a clean release of a held load by applying, to the magnet coil, a reverse current which is of smaller magnitude than the current applied to achieve lifting action. Such demagnetization is particularly necessary when lifting mixed loads such as scrap metal or when moving stacks of plates. With stacks of multiple plates, deenergizing the lift coil may release most of the load but the top plates may stick on the magnet, held by the residual magnetism.

In accordance with the conventional wisdom in the art, the necessary reverse current is applied to the coil lifting magnet by means of a reversing switch or contactors in the d.c. supply leads to the magnet. Operation of the contactors both broke the lift current and, through reversed connections, applied the reverse or drop current, this latter current being applied through a resistance appropriate for limiting the reverse current to the desired value. This system of interconnection has been conventional whether the basic supply to the magnet was a d.c. source such as rechargeable batteries or whether there was a bridge rectifier deriving direct current from a pair of a.c. supply leads or a generator.

As will be appreciated by those having practical experience, the switching of a heavy d.c. current to an electrical load having substantial inductance, as does a lifting magnet, produces severe arcing at the switch contacts. Thus the contactors required for such a current reversing operation have to be of exceptionally heavy and durable construction in order to survive myriad cycles of operation.

Contrary to this conventional wisdom, the present invention provides separate lift and demagnetizing coils in the magnet structure itself, each coil being provided with its own bridge rectifier means so that all switching can be accomplished on the a.c. supply leads.

SUMMARY OF THE INVENTION

Briefly, a lifting magnet system according to the present invention employs a core of magnetically permeable material providing at least a pair of exposed pole faces for engaging a load. A first coil linking the core is selectively energized from a first bridge rectifier means, the d.c. output terminals of the bridge rectifier means being directly connected to that first coil. A second coil linking the core is selectively energized from a second bridge rectifier means, the d.c. output terminals of that bridge rectifier means being directly connected to that second coil through a circuit including sufficient resistance to limit the magnetizing force produced by energization of the second coil to a selected fraction of the magnetizing force produced by energization of the first coil. The first coil is selectively energized from an a.c. supply lead by first current switching means and the second coil is selectively energized from the a.c. supply lead by a second current switching mean. Thus both lifting and releasing of the load involves switching of a.c. power only.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
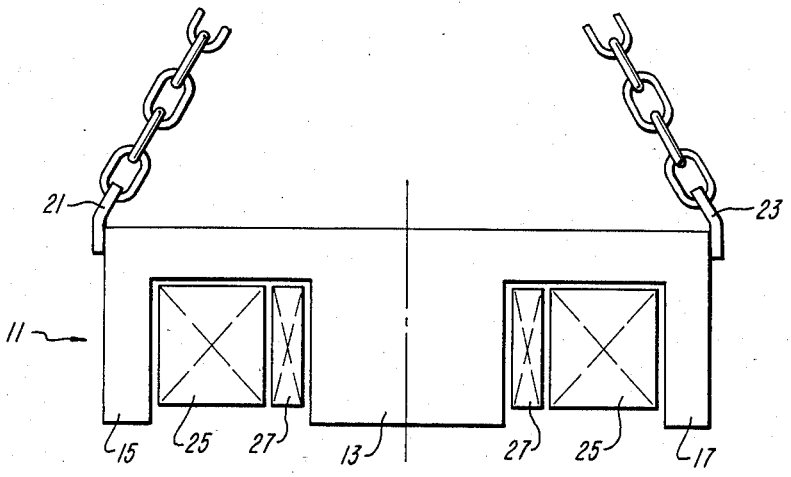
FIG. 1 is a side view, in section, of a lifting magnet constructed in accordance with the present invention.

Referring now to FIG. 1, the lifting magnet illustrated there employs an E-shaped core 11 providing three pole faces for engaging a load, i.e., a center pole face 13 and two outside pole pieces 15 and 17. Lifting eyes 21 and chains 23 are provided so that the lifting magnet, together with an engaged load, may be hoisted by means of a suitable crane or gantry (not shown).

Wound around the center pole piece 13 are a pair of coils, a lifting coil 25 and a release or drop coil 27. While these coils are shown as being physically separated, it should be understood that they might also be wound together in bifilar fashion. Since the release coil 27 will typically carry only a fraction of the current of the lift coil 25, it is typically wound with finer wire and is physically smaller than the lift coil. Higher resistance and higher power dissipation in a given space is also tolerable in the coil 27 for the reason that it typically energized only momentarily when releasing a load whereas the coil 25 is typically energized for the whole time a load is being held.

Figure 2:
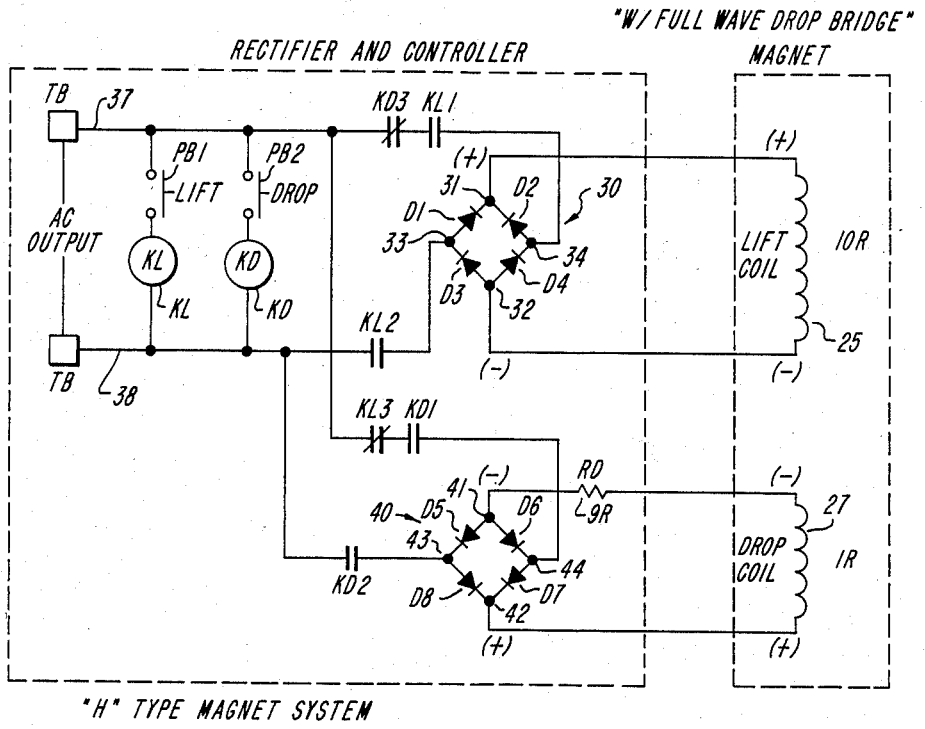
FIG. 2 is a schematic circuit diagram of the magnet together with rectifier and controller elements which operate in conjunction with the magnet in accordance with the practice of the present invention.

Referring now to FIG. 2, it may be seen that the lift coil 25 is connected directly to the d.c. output terminals 31 and 32 of a full wave rectifier bridge 30 comprising diodes D1–D4. As used in the context of the present invention, the term "directly" should be understood to mean a connection which does not involve any current switching elements which are operative during the normal functioning of the lifting magnet system.

The a.c. input terminals 33 and 34 of bridge 30 are connected to a.c. supply leads 37 and 38 through a pair of normally-open relay contacts KL1 and KL2 which are operable by means of a relay coil KL. The a.c. supply circuit to bridge 30 includes also a pair of normally-closed relay contacts KD3 which are operable by a relay coil KD.

As indicated previously, the drop coil 27 is provided with its own bridge rectifier, designated generally by reference character 40, and the drop coil 27 is connected directly to the d.c. output terminals 41 and 42 of this bridge rectifier. This connection, though direct in the sense described previously, is through a resistor RD whose value is chosen to hold the current through the drop coil 27 to a preselected value, typically about one-tenth of the current provided to the lift coil, assuming that both coils have an equal number of turns; if not, the product of the amperes times the turns should be about 1/10 of the lift coil. RD could be eliminated by winding coil 27 with finer wire having for example 10 times the resistance of coil 25 and the same number of turns as coil 25.

The a.c. input terminals 43 and 44 of bridge rectifier 40 are connected to the a.c. supply leads 37 and 38 through a pair of normally-open relay contacts KD1 and KD2, operable by relay coil KD, as well as through a normally-closed contact KL3, operable by the relay coil KL. The relay coils KL and KD are connected, through respective push button switches PB1 and PB2, across the AC supply leads 37 and 38.

From the foregoing circuit description, it will be understood that closing the switch PB1, will cause, through closure of the contacts KL1 and KL2, the energization of the lift magnet at full power through the bridge rectifier 30. At the same time the energization of the drop coil is inhibited by the opening of the normally closed contact KL3. In this state a magnetically permeable load may be engaged, picked up and moved. When the move is completed, opening of the switch PB1 and closure of the switch PB2 will cause deenergization of the lift coil 25 and energization, typically briefly, of the drop coil 27. Again, during actuation of the drop coil, energization of the lift coil is prevented by the opening of the normally-closed relay contacts KD3.

As will be perceived by those skilled in the art, the respective bridge rectifiers are never disconnected from the electrical loads which they energize. Thus, each of these inductive loads is always shunted by a set of diodes which will allow any inductively driven current to, in effect, "freewheel" until such current dies out of its own accord due to the inherent resistance in the circuit. In other words, d.c. current is not switched and it is not necessary to provide any contactor structure which is sufficiently robust to withstand the arcing which would be typically incurred by such switching. Rather, all power switching is performed on the a.c. side of each bridge rectifier means and is thus effectively isolated from inductively induced transients. As is understood, the reversing nature of a.c. current provides for quick arc extinction so that a.c. relays are relatively inexpensive as compared with d.c. contactors. In fact, the saving in controller component costs and increase in reliability more than offsets the slight additional cost of manufacturing incurred in manufacturing the slightly more complex magnetic structure.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A lifting magnet system comprising:

a core of magnetically permeable material providing at least a pair of exposed pole faces for engaging a load;

a first coil linking said core for selectively magnetizing said core to lift a load;

a pair of a.c. supply leads a first rectifier means having a.c. input terminals and d.c. output terminals, the d.c. output terminals being directly connected to said first coil;

a second coil linking said core for selectively demagnetizing said core to release a load;

a second rectifier means having a.c. input terminals and d.c. output terminals, the d.c. output terminals being directly connected to said second coil;

current switching means operative in a first state for connecting said a.c. supply leads to the input terminals of said first rectifier means and operative in a second state for connecting said a.c. supply leads to the input terminals of said second rectifier means, whereby lifting and releasing of a load involve switching of a.c. power only.

2. A lifting magnet system comprising:

a core of magnetically permeable material providing at least a pair of exposed pole faces for engaging a load;

a first coil linking said core for selectively magnetizing said core to lift a load;

a pair of a.c. supply leads a first bridge rectifier means having a.c. input terminals and d.c. output terminals, the d.c. output terminals being directly connected to said first coil;

a second coil linking said core for selectively demagnetizing said core to release a load;

a second bridge rectifier means having a.c. input terminals and d.c. output terminals, the d.c. output terminals being directly connected to said second coil, the circuit through which said second coil is energized including sufficient resistance to limit the magnetizing force produced in said core by said second coil to a selected fraction of the magnetizing force produced by said first coil;

first current switching means for selectively connecting said a.c. supply leads to the input terminals of said first bridge rectifier means;

second current switching means for selectively connecting said a.c. supply leads to the input terminals of said second bridge rectifier means whereby lifting and releasing of a load involve switching of a.c. power only.

3. A magnet system as set forth in claim 2 wherein said first current switching means includes a relay having normally-open contacts in series with the a.c. input terminals of said first bridge rectifier means and normally-closed contacts in series with the a.c. input terminals of said second bridge rectifier means and wherein said second current switching means includes a relay having normally-open contacts in series with the a.c. input terminals of said second bridge rectifier means and normally-closed contacts in series with the a.c. input terminals of said first bridge rectifier means.

* * * * *